United States Patent [19]

Terry et al.

[11] Patent Number: 4,546,867

[45] Date of Patent: Oct. 15, 1985

[54] COIN INSERT FOR VENDING MACHINE

[76] Inventors: David E. Terry, Range Rd., Rte. 8, Box 376, Palestine, Tex. 75801; Donald K. Christian, 119 Woodbine Ter., Spartanburg, S.C. 29301

[21] Appl. No.: 432,642

[22] Filed: Jan. 19, 1983

[51] Int. Cl.[4] ..... G07F 1/02

[52] U.S. Cl. ..... 194/1 D; 194/1 K

[58] Field of Search ..... 194/1 C, 1 D, 1 E, 1 K, 194/97 R, DIG. 7, DIG. 15, DIG. 29

[56] References Cited

U.S. PATENT DOCUMENTS

| | | | |
|---|---|---|---|
| 1,956,066 | 4/1934 | Gottfried | 194/97 R |
| 2,734,680 | 2/1956 | Jones | 194/1 K X |
| 4,093,058 | 6/1978 | Terry | 194/71 |
| 4,165,802 | 8/1979 | Mathews | 194/1 K |
| 4,211,317 | 7/1980 | Bellis | 194/1 K X |
| 4,306,644 | 12/1981 | Rockola et al. | 194/1 K |

OTHER PUBLICATIONS

*Multi-Mech Model 101-MM,* Southern News Rack Co., Palestine, Tex.

*Primary Examiner*—F. J. Bartuska

[57] ABSTRACT

A coin insert for use on vending machines that may be exposed to the weather. A pivotal flap is provided to deflect moisture from the coin path. A relief is provided in the coin slot to permit the free fall of a horizontally inserted coin. A coin return button with a protective skirt for use separately or in conjunction with a coin insert is taught. The use of a coin guiding surface which has been abraided to minimize the possibility of a wet coin clinging thereto is taught.

7 Claims, 3 Drawing Figures

COIN INSERT FOR VENDING MACHINE

BACKGROUND OF THE INVENTION

The introduction of coins into the coin mechanism of vending machines has taken many shapes over the years from simple vertical or horizontal slots provided in the face of a coin mechanism enclosure, to slide devices wherein is provided a plunger type apparatus to introduce one or two coins into a sensing area, to rather elaborate coin insert assemblies through which coins are conveyed by gravity into a coin mechanism. Coin return buttons are, on occasion, incorporated into the more elaborate insert assemblies. Each of the various configurations are, at times, quite satisfactory; however there are circumstances where none of these configurations are satisfactory. The Multi-Mech Model No. 101-MM newspaper vendor produced by Terry Manufacturing Co. and sold by Southern News Rack Co. is an example where none have proven satisfactory. By the very nature of their use, newspaper vendors are frequently located in the open, totally unsheltered from the weather, thus susceptible to getting wet. Most of the newspaper vendors currently in common usage utilize a relatively unsophisticated coin mechanism, mainly unaffected by a bit of water, into which coins are introduced through a vertical side or, in a manner of speaking, through the face thereof. The very nature of the side introduction limits the amount of moisture which can find its way into the coin mechanism enclosure. U.S. Pat. No. 4,093,058 Terry is an example of this type mechanism.

As the price of newspapers increases, the utility of this type mechanism decreases and the need for totalizing coin mechanisms that will accept a broad mix of coins increases. However, totalizing coin mechanisms are far more susceptible to water related malfunctions. In addition, many of the better totalizers, such as National Rejector's model 13-03-058, require top entry of coins. In the heretofore mentioned Multi-Mech models which use this type totalizer, the only practical location for the coin insert is on the top of the rack which is most likely to collect rain, snow and the like. To further aggravate the problem, a coin return button is also located on the same surface.

SUMMARY OF THE INVENTION

It is the object of the present invention to provide a means for inserting coins into the coin mechanism of a vending machine which is exposed to the weather that will minimize the amount of moisture that will pass therethrough.

It is further the object of the present invention to provide a means for actuating the coin return system of a coin mechanism that will minimize the amount of moisture that will pass therethrough.

It is further the object of the present invention to provide a horizontal coin slot which is so designed as to remove possible obstacles from a horizontal coin path to a vertical coin path.

It is still further the object of the present invention to provide a means for diverting from the coin path such moisture as may enter through said horizontal coin slot.

Generally speaking the present invention relates to the use of a horizontal coin slot with an optional flap therebehind as an entrance to a coin path which is provided with a drain to dispose of such moisture as may gain entrance prior to the entrance of a coin.

The present invention further relates to the use of a moisture resistant coin return button either separately or in conjunction with said coin path.

More specifically, the insert of the present invention relates to an enclosure for use on a vending machine through which is provided a horizontal slot of such configuration that a purchaser may readily insert a coin beyond any obstruction to a free fall change in direction. Directly adjacent to the inside of this horizontal slot may be provided a flap which is designed to interrupt the through passage of blowing rain or snow. Generally beneath this flap is provided an aperture to permit such moisture as may enter therein to drain away without gaining entry to the coin mechanism therebelow.

DESCRIPTION OF THE PREFERRED EMBODIMENTS

Preferred embodiments of the present invention will now be specifically described, making reference to the Figures.

Figure 1:
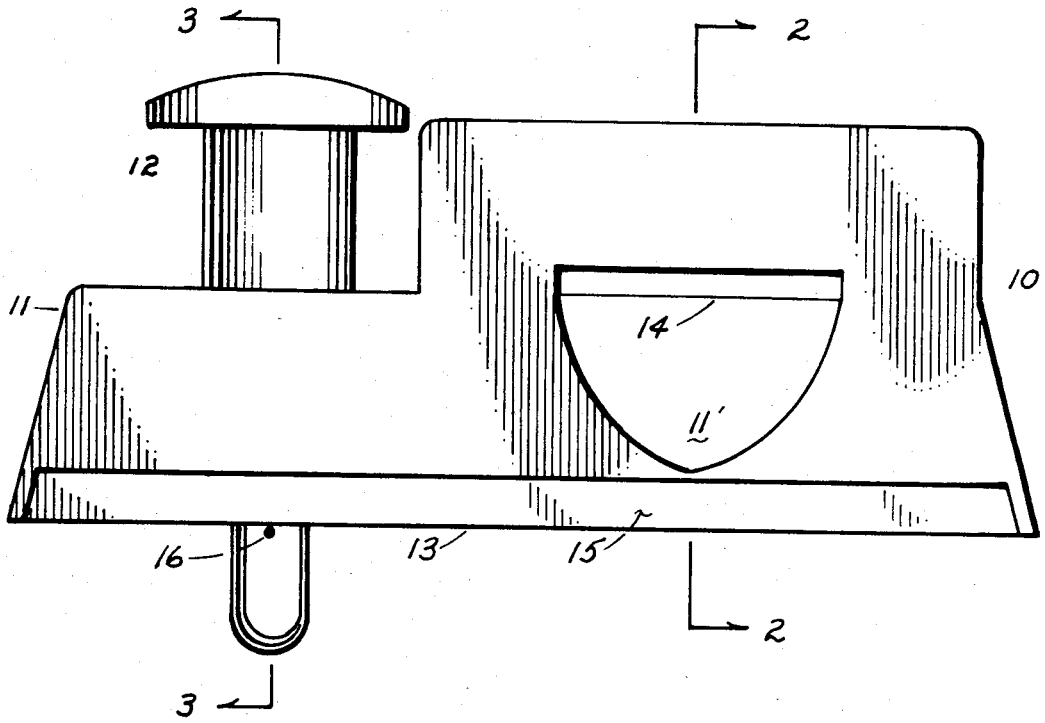
FIG. 1 is a front elevational view of the coin insert which has been provided with a push button according to the teachings of the present invention.

FIG. 1 illustrates the coin insert generally indicated as 10 which has been provided with housing 11, recess 11', push button 12, base 13, coin slot 14, drain area 15 and restraining pin 16.

Figure 2:
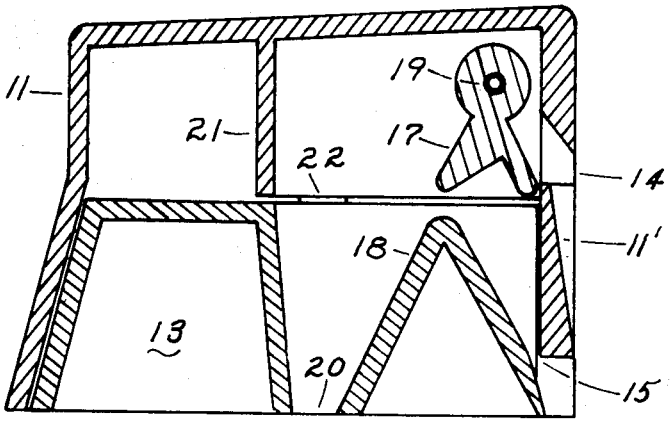
FIG. 2 is a cross section view of FIG. 1 taken along lines 2—2 and showing a flap, drain and baffle according to the teachings of the present invention.

As may be seen in FIG. 2, flap 17 is provided to interrupt such precipitation as may enter coin slot 14 causing same to follow the front side of baffle 18 on a path which will cause it to exit said insert by way of drain area 15. As coin is introduced into coin slot 14, flap 17, free to pivot about pins 19, which are, in turn, secured to housing 11, permits coin to progress to the back side of baffle 18. The distance between the apex of said baffle and the outside of coin insert 14 is less than half the diameter of the smallest coin anticipated. The top surface of coin slot 14 is, as may be seen, cut away at such angle as may be required to insure that no obstacle be present to impede the free fall of a coin on a path that will exit said coin insert through orifice 20. Flap 17 is provided with a heavier back leg to insure it will return to its heretofore mentioned position of interruptions as a coin passes out of its rotational path. Guide 21 is incorporated in housing 11 to insure that coins will follow a predetermined path as they pass through said insert. Appropriates bosses 22, nearly concealed by guide 21 and side of base 13, are provided in conjunction with such members of baffle 18 as may be required to secure said insert to the top of a vending machine. An appropriate sealer may be used between said coin insert and said vending machine to preclude leakages therebetween. Recess 11' is provided to insure that a coin inserted into coin slot 14, as far as is permitted by the physical obstruction of housing 11, will have passed the point where it might be restrained from falling by the upper surface of said coin slot.

While not specifically shown, back side of baffle 18 is abraided in such manner as to minimize the possibility of a wet coin clinging thereunto.

Figure 3:
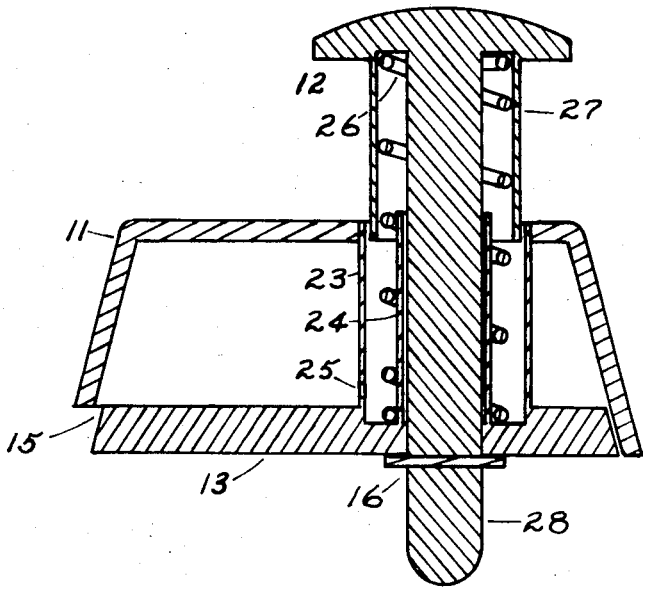
FIG. 3 is a cross sectional view of FIG. 1 taken along lines 3—3 showing a push button with an outer shield according to the teachings of the present invention.

In reference to FIG. 3, base 13 is provided with outer sleeve 23 and inner sleeve 24, both integral members thereof. Said outer sleeve is provided with drain 25. Push button 12 is biased upward by spring 26 and restrained by retaining pin 16. Said push button is provided with cylindrical skirt 27 and shank 28, both integral parts thereof. Precipitation may enter between cylindrical skirt 27 and its mating member outer sleeve 23; however, inner sleeve 24 prohibits access thereof to shank 28 or the coin mechanism thereinunder. Drain 25 and drain area 15 are provided to insure that no appreciable amount of said precipitation can accumulate within the sleeves of base 13.

While top mounting of the present invention has been described, face mounting can be advantageous. The present invention is currently used on two Southern News Rack models where coins are inserted through the face of coin mechanism enclosure.

It is to be understood that even though the push button of the present invention has been described in conjunction with a coin insert, it may be used advantageously in a separate housing or combined with yet other devices. It is to be understood that even though a spring biased push button reciprocating in a dual sleeved base has been described, single sleeved base either with or without a spring could accomplish the same end. Frequently, the spring bias of a coin mechanism is used to hold a coin return member in an extended position.

Having described the present invention in detail, it is obvious that one skilled in the art will be able to make modifications and variations thereto without departing from the scope of the invention. Accordingly, the scope of the present invention should be determined by the claims appended hereto.

What is claimed is:

1. A coin insert for a vending machine through which coins are introduced into a coin mechanism, said coin insert being comprised of;

(a) an enclosure generally associated with a coin receiving aperture, (b) a multiplicity of baffle surfaces one of which is so oriented as to direct coins through an orifice into a coin receiving device and (c) yet another of which is so oriented as to direct at least a portion of such precipitation as may enter said coin receiving aperture in a direction other than through said orifice, said baffle surfaces being joined at an apex and so positioned that the space between said apex and said coin receiving aperture is less than the diameter of the smallest coin to be inserted.

2. A coin insert as defined in claim 1 wherein is contained a pivotal flap so oriented as to divert from the coin path at least a portion of such precipitation as may enter through the coin receiving aperture thereof.

3. A coin insert as defined in claim 1 wherein a coin conducting surface is abraided to minimize the possibility of a wet coin adhering thereunto.

4. A coin insert as defined in claim 1 having a coin receiving aperture, with a relieved upper surface to facilitate the angular free fall of a coin.

5. A coin insert as defined in claim 4 having a recessed lower front surface to permit the use of external force to advance a coin to a position free from restraint.

6. A coin insert as defined in claim 1 or claim 2 wherewith is associated a push button which has been provided with:

(a) a shank at least in part surrounded by an outer shielding which is associated with a shank receiving member containing at least one projecting member which mates with said shank and said shielding to inhibit precipitation from passing therethrough.

7. A push button assembly for a vending machine which has been provided with (a) a push button having a shank at least in part surrounded by an outer shielding which is associated with (b) a base having a shank receiving member, comprised of a sleeve extending into said outer shielding, so oriented as to be shielded by said outer shielding in such manner as to inhibit precipitation from entering said vending machine through an opening provided for said push button.

* * * * *